United States Patent [19]

Weiss et al.

[11] 4,024,698

[45] May 24, 1977

[54] ASPIRATOR MUFFLER

[75] Inventors: William Robert Weiss, Walnut Creek, Calif.; James Judson Cooksey, Colonial Heights; Wilbur Leon Stables, Matoaca, both of Va.

[73] Assignee: Allied Chemical Corporation, Morris Township, N.J.

[22] Filed: July 16, 1976

[21] Appl. No.: 705,961

[52] U.S. Cl. ..... 57/34.5; 28/1.4; 57/1 R; 57/77.3; 181/42; 226/97

[51] Int. Cl.[2] ..... B65H 51/16

[58] Field of Search ..... 57/1 R, 34 B, 34.5, 57/77.3, 157 F; 28/1.4, 72, 12; 226/97, 91, 7; 181/33 R, 35 R, 42, 46

[56] References Cited

UNITED STATES PATENTS

| | | | |
|---|---|---|---|
| 3,094,262 | 6/1963 | Ashby et al. | 226/97 |
| 3,241,234 | 3/1966 | Kiefer et al. | 57/34.5 X |
| 3,423,000 | 1/1969 | Heinen | 226/97 |
| 3,713,509 | 1/1973 | Carroll | 57/1 R X |
| 3,718,270 | 2/1973 | Parmeggiani et al. | 57/34.5 X |

*Primary Examiner*—John Petrakes
*Attorney, Agent, or Firm*—Patrick L. Henry

[57] ABSTRACT

A muffler for use in conjunction with an aspirator during the production of multifilament, synthetic yarn is provided. Audible noise which is emitted at the inlet end of the aspirator is reduced by up to 22.5 ΔdB(A) and brought to within acceptable levels through the use of a perforated tube, resonant chamber, and sound absorbing means. The tension of the aspirated yarn is maintained by finishing the muffler inlet end with a high RMS surface.

14 Claims, 2 Drawing Figures

ASPIRATOR MUFFLER

BACKGROUND OF THE INVENTION

This invention relates to an apparatus for use during the production of multifilament, synthetic yarn. In particular it relates to a muffler, for use in conjunction with an aspirator, which reduces by up to 22.5 Δ dB(A) the noise emitted at the inlet end of the aspirator when the aspirator is operational, with substantially no loss in yarn tension.

Throughout the present specification and claims, the term "dB(A)" (decibels — A-weighted) connotes a unit of measurement of sound level corrected to the A-weighted scale, as defined in ANSI S1.4–1971, using a reference level of 20 micropascals ($2 \times 10^{-5}$ Newtons per square meter). The term "Δ dB(A)" refers to the difference between two noise levels where each level is expressed in units of dB(A). The term "yarn" is employed in a general sense to indicate strand material, either textile or otherwise, and including a continuous, often plied, strand composed of fibers, filaments, glass, metal, asbestos, paper, or plastic, or a noncontinuous strand such as staple, and the like. An "end" is one or a contiguous group of such strands of yarn. The term "RMS," which is an abbreviation of root-mean-square, is an arbitrary measurement of surface texture and is described in detail in the publication, Surface Texture (ASA B 46.1–1962), The American Society of Mechanical Engineers, United Engineering Center, 345 East 47th Street, New York 17, N.Y., page 16 (1962).

The invention is applicable to many phases of yarn handling, the particular use disclosed herein being merely illustrative and not limiting thereof.

Aspirators are often used in the melt-spin process subsequent to the extrusion and quench stages. An aspirator generally comprises inlet and outlet ends connected by a passageway to which a source of air under pressure is connected via an orifice or orifices. This air is introduced into the aspirator passageway to create an atmosphere productive of suction therethrough. By placing the aspirator sufficiently near the path of the yarn, operation of the aspirator will cause the yarn end or ends to pass therethrough to a collection receptacle. In multiple end spinning, a break in one of the yarn ends is detected by a sensing device which automatically triggers an aspirator located in close proximity to the running yarn ends. The yarn ends are then aspirated to waste at a collection receptacle to prevent the yarn from snarling or hanging up. Thereafter, the operator can cut the yarn ends at the aspirator inlet and proceed to string-up again. Due to equipment configuration or the dictates of the particular string-up device, it may be preferable to string-up only one yarn end at a time. If so, the aspirator provides a temporary means for maintaining any other yarn ends out of the way until the operator can string them up. Aspirators are also utilized in single end spinning, one application being that of a temporary collecting device during the windup stage when starting a new package.

With respect to any of the aforementioned applications, high velocity air is introduced into the aspirator passageway through an orifice or orifices to create the desired suction effect. As a consequence, noise is produced inside the aspirator at and downstream of the orifice(s). The sound waves thus generated are then propagated through the inlet and outlet ends of the aspirator. The operator is confronted primarily with the noise issuing from the inlet end of the aspirator as the noise traveling through the outlet end passes, along with the aspirated yarn, through exhaust pipes to a collection point which is shielded from the operator. The noise emitted, as measured 6 inches in front of the aspirator inlet end with an air supply line pressure ranging from 40 to 90 psig, has been found to exceed 100 dB(A) in some instances. The frequency component of the aspirator noise is situated in the high frequency levels, i.e., greater than 2,000 cycles per second, which has been shown to be more harmful than the low frequency levels.

Although the aspirator as described in the aforementioned situations is an intermittent source of noise, it could be a continuous noise source. In either event, as a major contributor of noise or as a minor component in a process which has several other sources of noise, it is desirable to bring the noise level down to tolerable limits.

There are several approaches to noise reduction in a work environment. One is the use of hearing protection devices such as helmets, ear plugs, or ear muffs by the operator exposed to the noise. The protection afforded, however, relates directly to proper use and maintenance of the devices. The difficulty, from a managerial viewpoint, lies in getting the operator to use these protective devices. To avoid this problem, applicants have provided a muffler which reduces the noise emitted at the inlet end of the aspirator by up to 22.5 Δ dB(A) and which thereby brings the noise to within acceptable levels.

The introduction of a muffler, however, presents another problem. The muffler of the present invention is adapted to fit over the inlet end of the aspirator. By being mounted in such a manner, it acts as a restrictor, resulting in decreased suction and a loss in yarn tension. Rather than design a more efficient aspirator, applicants have found that by finishing the muffler inlet end with a high RMS surface, there is a gain in yarn tension which compensates for the yarn tension loss produced by coupling the muffler of the present invention with the aspirator.

SUMMARY OF THE INVENTION

The present invention provides an apparatus for use during the production of multifilament, synthetic yarn. The essential elements are an aspirator and a muffler. The aspirator comprises an inlet end, an outlet end, a passageway connecting the inlet and outlet ends, and a source of air under pressure. The source of air under pressure is connected to the passageway so as to create an atmosphere productive of suction therethrough when operational. The muffler comprises housing means, a perforated tube, baffle means, sound absorbing material, mounting means, sealing means, and a surface finish. The housing means comprises an outlet end, and inlet end, and an elongated section extending between the inlet and outlet ends. The outlet end is shaped so as to couple with the inlet end of the aspirator without blocking the passageway therethrough. The perforated tube, the diameter of which is substantially smaller than the diameter of the housing means, is disposed between the inlet and outlet ends of the housing means and has an open area of from 40 to 60%. The baffle means are disposed approximately perpendicular to the central axes of the tube and housing means and is located at the end of the tube closer to the outlet end of the housing means without blocking the passage therethrough. The baffle means, in conjunction with the tube and housing means forms an annular resonant chamber. The sound absorbing material is disposed throughout the annular resonant chamber, and means is provided for mounting the housing means to the inlet end of the aspirator. The sealing means is disposed between the baffle means and the inlet end of the aspirator so as to permit air to enter the inlet end of the aspirator only via the inlet end of the housing means. A surface finish coats the inlet end of the housing means and has an RMS of between 30 and 120. When the aspirator is operational, yarn is aspirated through the inlet end of the housing means and through the tube into the aspirator. The surface finish causes a gain in yarn tension which compensates for the loss in yarn tension produced by coupling the muffler to the aspirator. Audible noise emitted at the inlet end of the aspirator is reduced by the use of the tube, resonant chamber, and sound absorbing material.

In the preferred embodiment, an aspirator, as described above, is coupled to a muffler which reduces the audible noise emitted at the inlet end of the aspirator by up to 22.5 Δ dB(A). The muffler comprises a generally cylindrical housing means, a generally cylindrical perforated tube, an end plate, sound absorbing material, mounting means, sealing means, and a surface finish. The housing means comprises an outlet end, an inlet end, and an elongated section extending between the inlet and outlet ends. The outlet end is shaped so as to couple with the inlet end of the aspirator without blocking the passageway therethrough. The inlet end of the housing means conically tapers inward at an angle of between 30° and 60° from the central axis of the housing means and has a beveled entry. The tube has a diameter substantially smaller than the diameter of the housing means and is disposed between the inlet and outlet ends of the housing means. The central axis of the tube approximately coincides with the central axis of the housing means. The tube has a plurality of perforations the diameters of which are between 0.0685 and 0.0825 inch, creating a total open area of from 40 to 60%. The ratio of the length of the tube to its inside diameter is between 3.7 to 1.0 and 5.5 to 1.0. The tube communicates with the inlet end of the aspirator when the outlet end of the housing means is coupled therewith. The end plate has a hole therethrough with a diameter slightly greater than that of the tube. The end plate is disposed approximately perpendicular to the central axes of the tube and housing means and encircles the end of the tube closer to the outlet end of the housing means to thereby form in conjunction with the housing means and tube an annular resonant chamber. Sound absorbing material is disposed throughout the annular resonant chamber, and means is provided for mounting the housing means to the inlet end of the aspirator. Sealing means is disposed between the end plate and the inlet end of the aspirator so as to permit air to enter the inlet end of the aspirator only via the inlet end of the housing means. A surface finish having an RMS of between 40 and 60 coats the inlet end of the housing means.

Accordingly, yarn is aspirated through the inlet end of the housing means and throgh the tube into the aspirator when the aspirator is operational. The surface finish causes a gain in yarn tension which compensates for the loss in yarn tension produced by coupling the muffler with the aspirator. The use of the tube, resonant chamber, and sound absorbing material functions to reduce the audible noise emitted at the inlet end of the aspirator up to 22.5 Δ dB(A) and to bring it within acceptable levels.

The invention will be more clearly understood and additional objects and advantages will become apparent upon reference to the discussion below and to the drawings which are given for illustrative purposes.

DETAILED DESCRIPTION OF THE DRAWINGS

Figure 1:
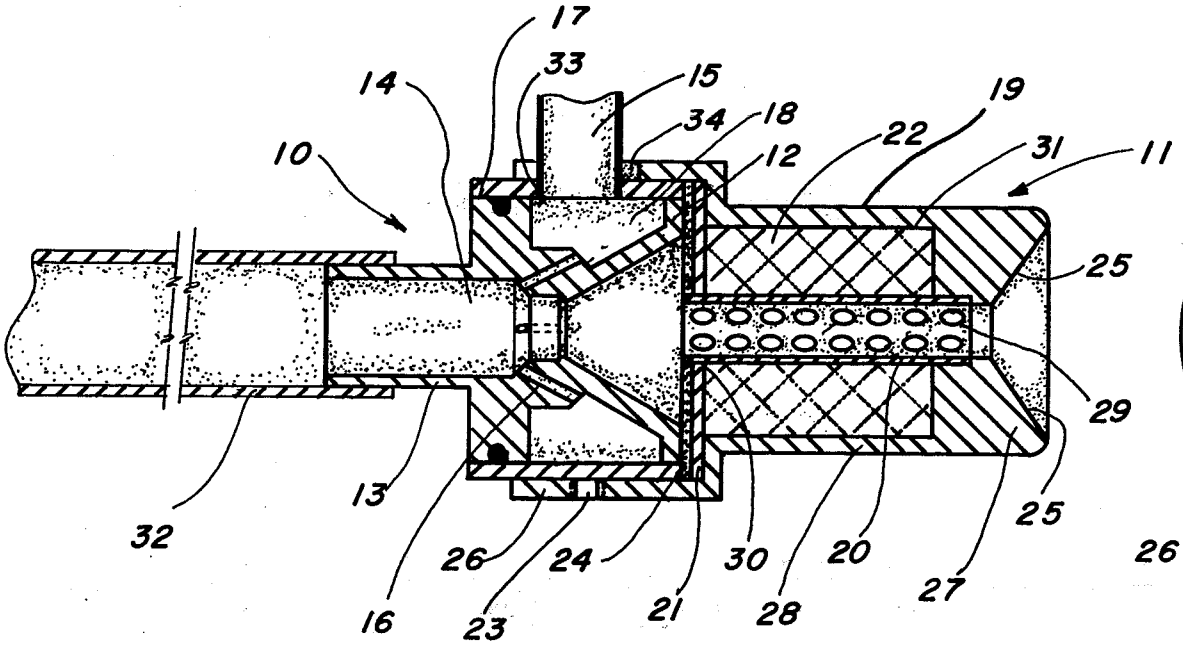
FIG. 1 is an enlarged vertical cross-section of the muffler coupled with the aspirator.

In the accompanying drawings, like numbers indicate like apparatus. Referring to FIG. 1, the aspirator and muffler of the present invention are designated broadly by, respectively, the numerals 10 and 11.

Aspirator 10 comprises an inlet end 12, an outlet end 13, a passageway 14 connecting the inlet 12 and outlet 13 ends, and a source of air under pressure. Inlet end 12 of aspirator 10 conically tapers toward passageway 14. At approximately the juncture of inlet end 12 and passageway 14 there are a plurality of radially spaced orifices 16 which open towards the downstream end of the aspirator 10. Surrounding inlet end 12 of aspirator 10 is a cylindrical casing 17 with a hole 33 therethrough adapted to receive a source of air under pressure, for example via pipe 15 which is fitted into the referenced hole 33. Cylindrical casing 17 in conjunction with inlet end 12 of aspirator 10 forms an annular air passage 18, suitably sealed so that ingress is only via pipe 15 and egress is only via orifices 16. Aspirator 10 operates as follows. The source of air under pressure is triggered by suitable means (not shown), to deliver high velocity air via pipe 15 into annular air passage 18 and on through orifices 16 into passageway 14 to create an atmosphere of suction therethrough.

Muffler 11 comprises a generally cylindrical housing means 19, a generally cylindrical perforated tube 20, an end plate 21, sound absorbing material 22, mounting means 23, sealing means 24, and a surface 25. Housing means 19 comprises an outlet end 26, an inlet end 27, and an elongated section 28 extending between the inlet 27 and outlet 26 ends. Outlet end 26 of muffler 11 is shaped so as to couple with inlet end 12 of aspirator 10 without blocking passageway 14 therethrough. In the preferred embodiment depicted in FIG. 1, outlet end 26 of muffler 11 is generally cylindrical in shape and has a diameter slightly larger than cylindrical casing 17 so that it can slideably engage therewith. Outlet end 26 of housing means 19 may have a slot 34 therein which lines up with hole 33 in cylindrical casing 17 to permit access for pipe 15 to annular air passage 18. Inlet end 27 of housing means 19 can have a perfectly flat face, but more preferably has a conically inward taper at an angle of between 30° and 60° from the central axis of housing means 19 with a beveled entry. Tube 20 has a diameter substantially smaller than the diameter of housing means 19 and is disposed between the inlet 27 and outlet 26 ends thereof. The central axis of tube 20 approximately coincides with the central axis of housing means 19. Should inlet end 27 of housing means 19 lack a conical taper, then it is preferred that tube 20 and the face of inlet end 27 be flush. Tube 20 has a plurality of perforations 29 therethrough which create a total open area of from 40 to 60%. It is preferred that the diameters of the perforations 29 be substantially equal and in the range of from 0.0685 to 0.0825 inch. It is also preferred that the ratio of the length of tube 20 to its inside diameter be between 3.7 to 1.0 and 5.5 to 1.0. Tube 20 communicates with inlet end 12 of aspirator 10 when outlet end 26 of housing means 19 is coupled therewith to form a passage to cavity transfer. End plate 21 has a hole 30 therethrough with a diameter slightly greater than that of tube 20. End plate 21 is disposed approximately perpendicular to the central axes of tube 20 and housing means 19, and encircles the end of tube 20 closer to outlet end 26 of housing means 19 to thereby form in conjunction with housing means 19 and tube 20 an annular resonant chamber 31. Sound absorbing material 22 is disposed throughout annular resonant chamber 31. End plate 21 acts as a rear wall baffle and can be formed as part of housing means 19. It is preferably kept as a separate element to permit ready access to annular resonant chamber 31 for any necessary replacement of sound absorbing material 22. For this purpose, end plate 21 may have a small notch (not shown) at its circumferential edge to facilitate its removal when muffler 11 is detached from aspirator 10. Means 23 is provided for mounting housing means 19 to inlet end 12 of aspirator 10 and may be, for example, set screws maintaining housing means 19 in contact with cylindrical casing 17. Sealing means 24 is disposed between end plate 21 and inlet end 12 of aspirator 10 so as to permit air to enter inlet end 12 of aspirator 10 via inlet end 27 of housing means 19. Sealing means 24 can comprise a resilient, readily deformable elastomeric material, for example, a rubber gasket having a configuration substantially corresponding to the shape of end plate 21 or a conventional O-ring seal. A finish coats surface 25 of inlet end 27 of housing means 19 and has an RMS of between 30 and 120, more preferably between 40 and 60.

In the preferred embodiment, aspirator 10 and muffler 11 are used subsequent to the extrusion and quench stages of the melt-spin process and are positioned such that one or more yarn end falls freely in a direction substantially perpendicular to the central axis of tube 20 of muffler 11. The yarn end(s) are sufficiently close to inlet end 27 of housing means 19 that operation of aspirator 10 causes them to be aspirated thereby. High velocity air at a supply line pressure of from 25 to 100 psig flows through pipe 15 into annular air passage 18 upon activation, which may be manual or by some triggering device. The air then flows into passageway 14 through orifices 16 to create an atmosphere of suction which will pull the yarn end(s) through, in succession, inlet end 27 of housing means 19, perforated tube 20, inlet end 12 of aspirator 10, passageway 14, outlet end 13 of aspirator 10, exhaust pipe 32, to be received as waste at a collection point (not shown). The sound waves generated inside aspirator 10 at and downstream of orifices 16 are propagated through inlet 12 and outlet 13 ends of aspirator 10. The noise travelling through outlet end 13 passes, along with the aspirated yarn, through exhaust pipe 32 to the yarn waste collection point which is shielded from the operator. The sound waves issuing from inlet end 12 of aspirator 10 travel into muffler 11 via perforated tube 20 where they are dissipated and attenuated. Annular resonant chamber 31 formed by housing means 19, end plate 21, and perforated tube 20 attenuates the noise by wave reflections and phase mismatching. The sound absorbing material 22 filling annular resonant chamber 31 dissipates sound by transforming the acoustical mechanical energy into heat energy. It should be noted that the heat produced is negligible and does not affect the quality of the process yarn.

The volume of annular resonant chamber 31, the number of perforations 29 in tube 20, and the thickness of tube 20 determines the resonance frequency of muffler 11. We have found that an open area of between 40 and 60% for tube 20 is preferable when dealing with a frequency component situated in the high frequency levels, i.e., greater than 2,000 cycles per second, as is characteristic of the noise emitted by aspirator 10. If tube 20 has an open area in excess of 60%, the resonance frequency of muffler 11 will be lowered, and if tube 20 has an open area of less than 40%, the dissipative effect of muffler 11 will decrease.

Figure 2:
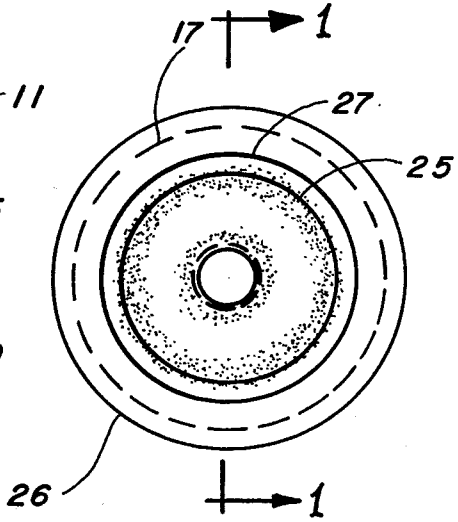
FIG. 2 is a plan view of the inlet end of the muffler.

Because muffler 11 is mounted in the aforementioned manner, it acts as a restrictor, resulting in less suction at inlet end 27 of housing means 19 where the yarn is to be aspirated than at inlet end 12 of aspirator 10 where the yarn was formerly aspirated. As a consequence, there is also a loss in yarn tension. We have found that by coating inlet end 27 of housing means 19 with a finish on surface 25 of between 30 and 120 RMS, more preferably between 40 and 60 RMS, there is a gain in yarn tension which compensates for the yarn tension loss produced by coupling muffler 11 with aspirator 10. The finish may for example comprise a ceramic coating, a machine finish, a matte chrome finish, or a sand blast finish. Reference should be made to FIG. 2 which depicts a plan view of inlet end 27 of muffler 11.

As indicated, the preferred ratio of the length of tube 20 to its inside diameter is between 3.7 to 1.0 and 5.5 to 1.0. It should be noted, however, that aspirator 10 and muffler 11 can function in conjunction with one another outside of this range, albeit with less advantageous results. An increase in the ratio corresponds to an increase in tube 20 length and results in excess noise reduction; although this appears desirable, there is also an additional decrease in yarn tension due to the increased distance between aspirator 10 and the yarn to be aspirated. A decrease in the ratio corresponds to a decrease in tube 20 length and results in a gain in yarn tension; there is, however, a concomitant lessening of noise reduction capacity on the part of muffler 11. Thus, the dimensions of tube 20, and correspondingly of muffler 11, the surface finish coating muffler inlet end 27, and the characteristics of the aspirator to be utilized are all highly interdependent and must be balanced to achieve optimum noise reduction without interfering with the velocity of fiber transit.

The materials of construction are preferably as follows: for the sound absorbing material, asbestos fibers or an open-celled foam, for example, fine pore polyester urethane foam, more preferably the latter; for the sealing means, a resilient readily deformable elastomeric material, for example, silicone rubber; for the preforated tube, a metal such as stainless steel; for the screws, carbon steel; and for the other elements, a metal such as stainless steel or aluminum, more preferably the latter for reasons of economy.

EXAMPLE 1

The apparatus of the present invention was set up in a sound laboratory as shown in FIG. 1. Inlet end 27 of muffler 11 had a conically inward taper at an angle of 52° from the central axis of housing means 19. The diameters of perforations 29 were approximately 0.075 inch, creating a total open area of approximately 50% for tube 20. The ratio of the length of tube 20 to its inside diameter was approximately 4.6 to 1.0, and the finish on surface 25 had an RMS of 40. A fine pore polyester urethane foam was utilized as the sound absorbing material 22, more specifically Scottfelt Grade 3-900 manufactured by the Scott Paper Company, Foam Division. The air supply line pressure was varied from 40 to 90 psig. at 10 unit intervals, and the noise level [dB(A)] was measured 6 inches in front of muffler inlet end 27 on the central axis of tube 20. The results obtained are shown in Table I along with comparative data obtained by measuring the noise level of the aspirator 10 without the muffler 11. The muffler reduced the aspirator noise level by approximately 22.5 Δ dB(A).

Further measurements were obtained at intervals of 12, 18 and 24 inches in front of muffler inlet end 27 on the central axis of tube 20, with an air supply line pressure of 90 psig. The noise levels were, respectively, 87.5, 84.0, and 81.5 dB(A) at these distances. Although aspirator 10 as described herein functions as an intermittent noise source and therefore all of the noise levels measured with the use of muffler 11 are acceptable, it could function as a continuous noise source. At a distance of 1.5 feet from muffler inlet end 27 the maximum noise level is 84.0 dB(A), which is below the present and proposed eight hour maximum continuous noise exposure levels of, respectively, 90 and 85 dB(A).

Example 1 above illustrates said preferred apparatus of the present invention and is not to be considered limiting of the invention in any means. Various modifications and other advantages will be apparent to one skilled in the art, and it is intended that this invention be limited only as set forth in the following claims.

TABLE I

| Air Supply Line Pressure (psig) | 40 | 50 | 60 | 70 | 80 | 90 |
|---|---|---|---|---|---|---|
| Noise Level Without Muffler [dB (A)] | 111.5 | 113.5 | 114.5 | 115 | 115.5 | 115.5 |
| Noise Level with Muffler [dB (A)] | 92 | 91.5 | 92 | 92.5 | 93 | 93 |
| ΔdB(A) | 19.5 | 22 | 22.5 | 22.5 | 22.5 | 22.5 |

We claim:

1. An apparatus for use during the production of multifilament, synthetic yarn, said apparatus comprising:

A. an aspirator, said aspirator comprising:
- A-1. an inlet end;
- A-2. an outlet end;
- A-3. a passageway connecting said inlet and said outlet ends; and
- A-4. a source of air under pressure, said source of air under pressure being connected to said passageway so as to create an atmosphere productive of suction therethrough when operational; and B. a muffler, said muffler comprising:
- B-1. generally cylindrical housing means, said housing means comprising:
  - a. an outlet end, said outlet end being shaped so as to couple with said inlet end of said aspirator without blocking said passageway therethrough;
  - b. an inlet end, said inlet end conically tapering inward at an angle of between 30° and 60° from the central axis of said housing means and having a beveled entry; and
  - c. an elongated section extending between said inlet and said outlet ends of said housing means;
- B-2. a generally cylindrical perforated tube, said tube having a diameter substantially smaller than the diameter of said housing means, said tube being disposed between said inlet and said outlet ends of said housing means, the central axis of said tube approximately coinciding with the central axis of said housing means, said tube having an open area of from 40 to 60%, the ratio of the length of said tube to the inside diameter of said tube being between 3.7 to 1.0 and 5.5 to 1.0, said tube communicating with said inlet end of said aspirator when said outlet end of said housing means is coupled therewith, said tube having a plurality of perforations the diameters of which are between 0.0685 and 0.0825 inch;
- B-3. an end plate, said end plate having a hole therethrough with a diameter slightly greater than that of said tube, said plate being disposed approximately perpendicular to the central axes of said tube and said housing means and encircling the end of said tube closer to said outlet end of said housing means to thereby form in conjunction with said housing means said tube an annular resonant chamber;
- B-4. sound absorbing material disposed throughout said annular resonant chamber;
- B-5. means for mounting said housing means to said inlet end of said aspirator;
- B-6. sealing means, said sealing means being disposed between said end plate and said inlet end of said aspirator so as to permit air to enter said inlet end of said aspirator only via said inlet end of said housing means; and
- B-7. a surface finish, said surface finish coating said inlet end of housing means and having an RMS of between 40 and 60; whereby said yarn is aspirated through said inlet end of said housing means and through said tube into said aspirator when said aspirator is operational, said surface finish causing a gain in yarn tension which compensates for the loss in yarn tension produced by coupling said muffler to said aspirator, and whereby the audible noise emitted at said inlet end of said aspirator is reduced up to 22.5 Δ dB(A) and brought to within acceptable levels by the use of said tube, said resonant chamber, and said sound absorbing material.

2. The apparatus of claim 1 wherein said inlet end of said housing means tapers conically inward at an angle of approximately 52°.

3. The apparatus of claim 1 wherein said ratio of the length of said tube to the inside diameter of said tube is approximately 4.6 to 1.0.

4. The apparatus of claim 1 wherein said surface finish has an RMS of approximately 40.

5. The apparatus of claim 1 wherein the diameter of said perforations are approximately 0.075 inch.

6. The apparatus of claim 1 wherein said sealing means comprises a resilient, readily deformable elastomeric material having a substantially annular configuration corresponding to the shape of said end plate.

7. The apparatus of claim 1 wherein said sound absorbing material is selected from the group consisting of asbestos fibers or fine pore polyester urethane foam.

8. An apparatus for use during the production of multifilament, synethetic yarn, said apparatus comprising:

A. an aspirator, said aspirator comprising:
- A-1. an inlet end;
- A-2. an outlet end;
- A-3. a passageway connecting said inlet and said outlet ends; and
- A-4. a source of air under pressure, said source of air under pressure being connected to said passageway so as to create an atmosphere productive of suction therethrough when operational; and B. a muffler, said muffler comprising:
- B-1. housing means, said housing means comprising:
  - a. an outlet end, said outlet end being shaped so as to couple with said inlet end of said aspirator without blocking said passageway therethrough;
  - b. an inlet end; and
  - c. an elongated section extending between said inlet and said outlet ends of said housing means;
- B-2. a perforated tube, said tube having a diameter substantially smaller than the diameter of said housing means, said tube being disposed between said inlet and said outlet ends of said housing means, said tube having an open area of from 40 to 60%;
- B-3. baffle means, said baffle means being disposed approximately perpendicular to the central axes of said tube and said housing means and being located at the end of said tube closer to said outlet end of said housing means without blocking the passage therethrough, said baffle means forming an annular resonant chamber in conjunction with said tube and said housing means;
- B-4. sound absorbing material disposed throughout said annular resonant chamber;
- B-5. means for mounting said housing means to said inlet end of said aspirator;
- B-6. sealing means, said sealing means being disposed between said baffle means and said inlet end of said aspirator so as to permit air to enter said inlet end of said aspirator only via said inlet end of said housing means; and
- B-7. a surface finish, said surface finish coating said inlet end of said housing means and having as RMS of between 30 and 120; whereby said yarn is aspirated through said inlet end of said housing means and through said tube into said aspirator when said aspirator is operational, said surface finish causing a gain in yarn tension which compensates for the loss in yarn tension produced by coupling said muffler to said aspirator, and whereby the audible noise emitted at said inlet end of said aspirator is reduced by the use of said tube, said resonant chamber, and said sound absorbing material.

9. The apparatus of claim 8 wherein said housing means has a substantially cylindrical shape.

10. The apparatus of claim 8 wherein the ratio of the length of said tube to the inside diameter of said tube is between 3.7 to 1.0 and 5.5 to 1.0.

11. The apparatus of claim 8 wherein said inlet end of said housing means tapers inward at an angle of between 30° and 60° from the central axis of said housing means.

12. The apparatus of claim 8 wherein said surface finish has an RMS of between 40 and 60.

13. The apparatus of claim 8 wherein said sealing means comprises a resilient, readily deformable elastomeric material having a configuration substantially corresponding to the shape of said baffle means.

14. The apparatus of claim 8 wherein said sound absorbing material is selected from the group consisting of asbestos fibers or fine pore polyester urethane foam.

* * * * *

UNITED STATES PATENT AND TRADEMARK OFFICE

CERTIFICATE OF CORRECTION

PATENT NO. : 4,024,698

DATED : May 24, 1977

INVENTOR(S) : William Robert Weiss, James Judson Cooksey and Wilbur Leon Stables It is certified that error appears in the above-identified patent and that said Letters Patent are hereby corrected as shown below:

Column 10, line 13, "as" should read --an--.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*